US009644795B2

(12) United States Patent
Burnette

(10) Patent No.: US 9,644,795 B2
(45) Date of Patent: May 9, 2017

(54) FRACTURING FLUID PROCESS PLANT AND METHOD THEREOF

(71) Applicant: Blake Burnette, Tomball, TX (US)

(72) Inventor: Blake Burnette, Tomball, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 799 days.

(21) Appl. No.: 13/718,429

(22) Filed: Dec. 18, 2012

(65) Prior Publication Data

US 2014/0169122 A1 Jun. 19, 2014

(51) Int. Cl.
*F17D 1/08* (2006.01)

(52) U.S. Cl.
CPC ..... *F17D 1/08* (2013.01); *Y10T 137/86187* (2015.04)

(58) Field of Classification Search
CPC ..... F17D 1/08
USPC ..... 366/181.1, 181.3, 182.4; 137/263, 137/265–267
See application file for complete search history.

(56) References Cited

U.S. PATENT DOCUMENTS 683,327 A * 9/1901 Prinz ..... B01F 15/0201 137/263
802,996 A * 10/1905 Von Krottnaurer ... B01F 13/002 366/182.3
1,812,604 A * 6/1931 Morrow ..... B01F 13/1002 210/112
3,877,682 A * 4/1975 Moss ..... 366/132
4,091,840 A * 5/1978 Grove et al. ..... 137/561 R
4,111,314 A 9/1978 Nelson
4,332,483 A * 6/1982 Hope et al. ..... 366/132
4,715,721 A * 12/1987 Walker et al. ..... 366/132
4,812,047 A * 3/1989 Baumann ..... 366/141
4,850,750 A * 7/1989 Cogbill et al. ..... 406/82
4,919,540 A 4/1990 Stegemoeller et al.
4,964,732 A * 10/1990 Cadeo et al. ..... 366/152.1
5,044,819 A * 9/1991 Kilheffer et al. ..... 404/72
5,149,192 A * 9/1992 Hamm et al. ..... 366/8
5,234,268 A * 8/1993 Homan ..... 366/160.4
(Continued)

OTHER PUBLICATIONS

International Search Report and Written Opinion, International Application No. PCT/US2013/069151, Date of Mailing Feb. 21, 2014, Korean Intellectual Preporty Office, International Search Report 5 pages; Written Opinion 7 pages.
(Continued)

*Primary Examiner* — Abbas Rashid
(74) *Attorney, Agent, or Firm* — Cantor Colburn LLP

(57) ABSTRACT

A process plant includes a base having a plurality of module receiving areas, each area configured to receive a supply module. At least one of the receiving areas additionally configured to receive a blender. A plurality of interconnection pipings fixedly arranged relative to the base. Each piping interconnecting each of the module receiving areas to each other; and connections on each of the interconnection pipings at each of the module receiving areas. Each connection configured to selectively connect and disconnect either a supply module or blender within a respective module receiving area from its respective interconnection piping. A method of processing a fracturing fluid is also included.

17 Claims, 8 Drawing Sheets

(56) References Cited

U.S. PATENT DOCUMENTS

| | | | | |
|---|---|---|---|---|
| 5,390,694 | A * | 2/1995 | Zimmerly | B08B 9/093 137/240 |
| 6,193,402 | B1 * | 2/2001 | Grimland et al. | 366/14 |
| 7,302,958 | B2 * | 12/2007 | Worczinski | C12C 11/006 137/1 |
| 7,926,564 | B2 | 4/2011 | Phillippi et al. | |
| 8,596,298 | B2 * | 12/2013 | Burmester | B67D 7/36 137/240 |
| 8,714,185 | B2 * | 5/2014 | Burmester | B67D 7/36 137/240 |
| 9,051,537 | B2 * | 6/2015 | Fahrner | C12C 13/00 |
| 2001/0000996 | A1 | 5/2001 | Grimland et al. | |
| 2005/0006089 | A1 | 1/2005 | Justus et al. | |
| 2008/0257449 | A1 | 10/2008 | Weinstein et al. | |
| 2008/0264641 | A1 | 10/2008 | Slabaugh et al. | |
| 2009/0301725 | A1 * | 12/2009 | Case et al. | 166/308.1 |
| 2010/0132949 | A1 | 6/2010 | DeFosse et al. | |
| 2011/0063942 | A1 * | 3/2011 | Hagan et al. | 366/152.2 |
| 2011/0272155 | A1 | 11/2011 | Warren | |
| 2011/0272158 | A1 | 11/2011 | Neal | |
| 2012/0099954 | A1 | 4/2012 | Teichrob et al. | |
| 2012/0147694 | A1 * | 6/2012 | Engel | 366/144 |
| 2012/0181013 | A1 | 7/2012 | Kajaria et al. | |

OTHER PUBLICATIONS

Halliburton, "Stim Star Angola" Stimulation Vessel Designed to Meet Offshore West Africa Requirements, Stimulation, www.halliburton.com, 2009, H06754 Nov. 2009, pp. 1-4.

* cited by examiner

FRACTURING FLUID PROCESS PLANT AND METHOD THEREOF

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. To increase the production from a borehole, the production zone can be fractured to allow the formation fluids to flow more freely from the formation to the borehole. The fracturing operation includes pumping fluids at high pressure towards the formation to form formation fractures. To retain the fractures in an open condition after fracturing pressure is removed, the fractures must be physically propped open, and therefore the fracturing fluids commonly include solid granular materials, such as sand, generally referred to as proppants.

The granular material used for proppant can be brought to the borehole location via road, rail, or water. Transportable silos containing the proppant are situated at an area near the borehole and a conveyor belt system is used to deliver the proppant to a hopper, which subsequently feeds to a blender as needed. The blender can also receive a number of other materials including water and dry or fluidic chemical additives to create the fracturing fluid. The additives are added by an operator or hopper, while the liquid materials are delivered to the blender from a water source using hoses.

As time, manpower requirements, and mechanical maintenance issues are all variable factors that can significantly influence the cost effectiveness and productivity of a fracturing operation, the art would be receptive to improved apparatus and methods for processing fracturing fluids.

BRIEF DESCRIPTION

A process plant includes a base having a plurality of module receiving areas, each area configured to receive a supply module, at least one of the receiving areas additionally configured to receive a blender; a plurality of interconnection pipings fixedly arranged relative to the base, each piping interconnecting each of the module receiving areas to each other; and connections on each of the interconnection pipings at each of the module receiving areas, each connection configured to selectively connect and disconnect either a supply module or blender within a respective module receiving area from its respective interconnection piping.

A method of processing a fracturing fluid, the method includes providing a water supply module, a chemical additive supply module, and a proppant supply module within the module receiving areas of the base in the process plant of Claim 1; arranging a blender below the proppant supply module; creating a gel by selectively opening and closing the connections on the plurality of interconnection pipings to create a pathway from the water supply module to the chemical additive supply module; and, selectively opening and closing the connections on the plurality of interconnection pipings to create a pathway to deliver the gel from the chemical additive supply module to the blender; and adding proppant from the proppant supply module to the blender and mixing the proppant with the gel to form the fracturing fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
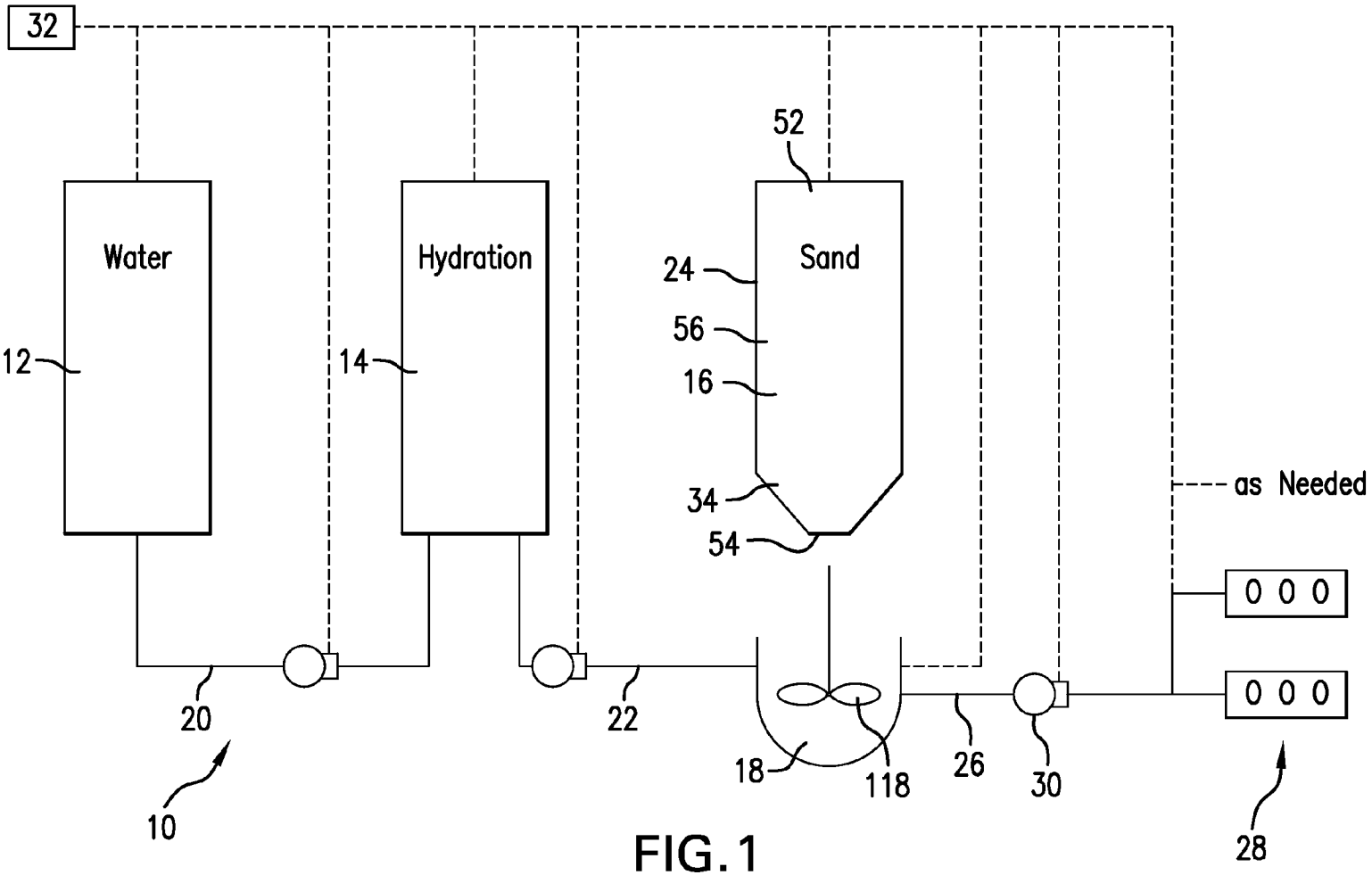
FIG. 1 shows a schematic diagram of an exemplary embodiment of a fracturing fluid process plant.

FIG. 1 shows an overview of a fracturing fluid process plant 10. While the plant 10 is described for the preparation of slurry used as fracturing fluid, the plant 10 may also be employed for the creation of other mixtures. The plant 10 includes a water supply module 12, a chemical additive supply module 14, a proppant supply module 16, and a blender 18. While water is specified as the liquid within the water supply module 12, it should be understood that alternative liquids may be employed including treated water, a water solution including water and one or more other elements or compounds, or another liquid. The water supply module 12 includes water or treated water stored in a tank, silo, or the like situated at any location convenient to the plant 10. Alternatively, the water supply can be brought to the site within a tanker truck, locomotive, etc. In an exemplary embodiment, the water supply module 12 is seated on a base, platform, or trailer bed, hereinafter referred to as a "base" that will be further described below. Water from the water supply module 12 is directed to the chemical additive supply module 14 via a water line 20. This process of delivering water to the chemical additive supply module 14 is relatively uncomplicated because water is a free-flowing liquid. The chemical additive supply module 14 is typically a powder material and not capable of freely flowing through lines without the addition of water. Like the water supply module 12, the chemical additive supply module 14 can be delivered to the site and seated upon the base of the fracturing fluid process plant 10. The chemical additive can include any material, including food grade materials. When the water from the water line 20 is added to the chemical additive supply module 14, a mixture such as a gel is formed. Water from the water line 20 and chemical additive from the chemical additive supply module 14 may be mixed in a blender (not shown). The resultant gel is capable of flowing through a gel line 22. The gel line 22 is attached to the blender 18.

Proppant, such as sand, which is also not capable of flowing through lines on its own, is added directly to the blender 18 from the proppant supply module 16 to be combined with gel from the gel line 22. In one exemplary embodiment, as will be further described with respect to FIG. 2, the proppant is added directly to the blender 18 from a silo 24 instead of being carried by a conveyor belt or delivered via a hopper. The combination of proppant and gel within the blender tub 18 forms a fracturing fluid slurry that flows through a slurry line 26 towards one or more high pressure pumps 28 for delivery into the borehole (not shown). A centrifugal pump 30 is used at the slurry line 26 for delivering the slurry from the blender 18 to the pumps 28. The centrifugal pump 30 receives the fluid from the blender 18, and converts rotational energy of the fluid, such as through the use of a pump impeller within the centrifugal pump 30, to moving energy of the fluid towards the high pressure pumps 28. While potentially unnecessary, centrifugal pumps 30 may also be employed at the water line 20 and gel line 22 as needed.

The flow of water through the water line 20, gel through the gel line 22, and slurry through the slurry line 26 may all be electrically controlled via a central control system 32. The control system 32 allows an operator to control actuated valving at the water line 20, gel line 22, and slurry line 26 to route the fluids as needed. The control system 32 may also be in electrical communication with the water supply module 12, chemical additive supply module 14, proppant supply module 16, and blender 18 for monitoring and metering each material and controlling their combination. The control system 32 may additionally be in communication with the high pressure pumps 28, or in communication with controls (not shown) of the high pressure pumps 28. For example, a control of the high pressure pumps 28 may indicate to the control system 32 that more fracturing fluid is required, which in turn will signal the production of additional fracturing fluid slurry to the components of the fracturing fluid process plant 10.

Figure 2:
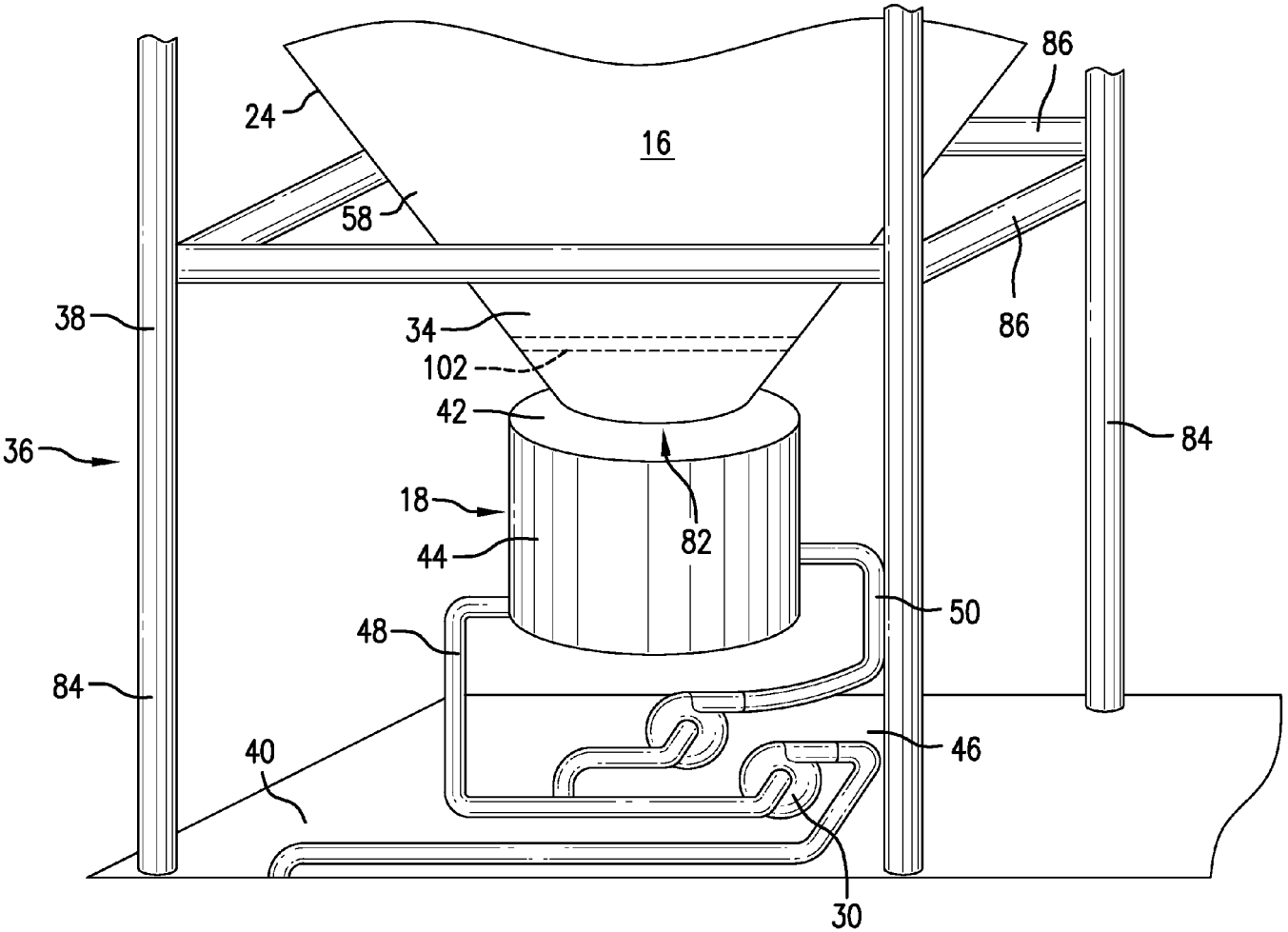
FIG. 2 shows perspective view of an exemplary support structure, exemplary blender tub, and an exit portion of an exemplary proppant silo for the fracturing fluid process plant of FIG. 1.

FIG. 2 shows a portion of the fracturing fluid process plant 10 including transportable silo 24. The fracturing fluid process plant 10 in this exemplary embodiment is a "flip up" electric fracturing fluid process plant in that the transportable silo 24 of the proppant supply module 16 is carried to the plant 10 and then "flipped up" to allow the proppant to flow through an exit portion 34 of the silo 24 due to gravity. The silo 24 is supported by a support structure 36, the support structure 36 including support beams 38 and a base 40. The silo 24 includes the exit portion 34 substantially longitudinally aligned with a mouth or opening 42 of the blender tub 44. That is, an output port 82 of the silo 24 is vertically aligned with the opening 42. In an exemplary embodiment, the exit portion 34 is sized for situating directly upon the opening 42. The blender tub 44 is seated on a blender tub receiving area 46 of the base 40. The blender tub 44 is thus supported on the base 40 of the support structure 36. At least one fluid connection piping 48 for introducing additional material, such as gel from the gel line 22, into the blender tub 44, is integrated into or fixedly secured to the base 40. Additionally, at least one fluid connection piping 50 for delivering fracturing fluid slurry from the blender tub 44 to the hydraulic high pressure pumps 28 (FIG. 1) is integrated into or fixedly secured to the base 40. The above-described individual components as well as additional components of the fracturing fluid process plant 10 will be further described below.

The transportable silo 24 includes an upstream end 52 and a downstream end 54. The exit portion 34 is located adjacent the downstream end 54. The upstream end 52 may include an accessible opening (not shown) for receiving proppant prior to delivery at the location, or for refilling as needed. The silo 24 is delivered to the fracturing fluid process plant 10, and contains an amount of proppant, such as the quantity required for preparing the slurry, or more or less than the quantity required for preparing the slurry. The control system 32 can be used to control the amount of proppant added to the blender tub 44 at any particular time.

While the proppant contained within the silo 24 is typically sand, the fracturing fluid fracturing process plant 10 is not limited to a sand-filled silo. Other proppants storable within the silo 24 include, but are not limited to, glass beads, sintered metals, walnut shells, etc. Also, while the silo 24 disclosed herein is described for carrying proppant, other materials for a fracturing fluid slurry may be stored within the silo 24, although the exit portion 34 would have to be designed to allow for the proper exit of a material, such as fluidic material or a powder material, to be properly dispensed from the silo 24.

The silo 24 includes a storage tank portion 56 directly connected to the exit portion 34 and upstream of the exit portion 34, such that proppant material upstream of the exit portion 34 can readily flow downstream due to gravity towards the exit portion 34 when the silo 24 is in an upright or tilted position. The exit portion 34 includes a tapered surface 58, such as a cone shape, which assists in mating with the blender tub 44 in one exemplary embodiment. The tapered surface 58 of the exit portion 34 also allows for a limited and controlled egress of the proppant from the storage tank portion 56 into the blender tub 44. To prevent premature delivery of the proppant from the storage tank portion 56 to the blender tub 44 and to prevent over-filling the blender tub 44 at any one time, a selective blocking member 102, such as a gate, valve, and/or metering system can be further included within the silo 24.

Figure 3:
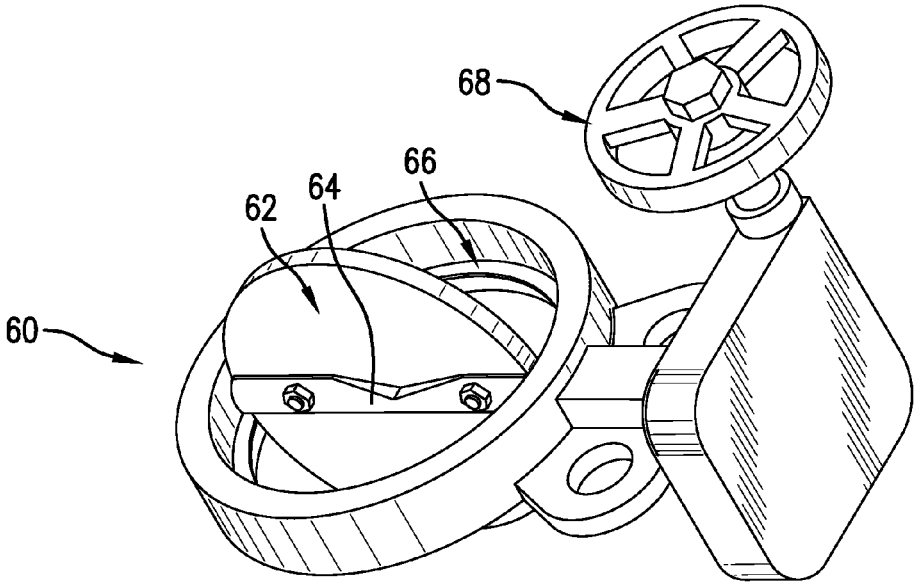
FIG. 3 shows a perspective view of an exemplary butterfly valve for the proppant silo.

A gate can be positioned in the exit portion 34, or between the exit portion 34 and the storage tank portion 56. In an exemplary embodiment, the gate may include a butterfly valve 60, as shown in FIG. 3, to isolate or regulate flow from the storage tank portion 56 to the blender tub 44. The butterfly valve 60 can enable quick shut off of flow. The butterfly valve 60 includes a disk 62 as a flow closure member and at least one stem 64 for supporting the disc 62 relative to an interior of the silo 24. The interior of the silo 24 into which the butterfly valve 60 can be installed includes a seat 66 having an interference fit between an edge of the disc 62 and the seat 66 to affect a successful closure. While the butterfly valve 60 may be electrically controlled, such as via control system 32, an operator portion 68, typically a lever, should be further included to manually adjust or close the valve 60 as necessary.

Figure 4:
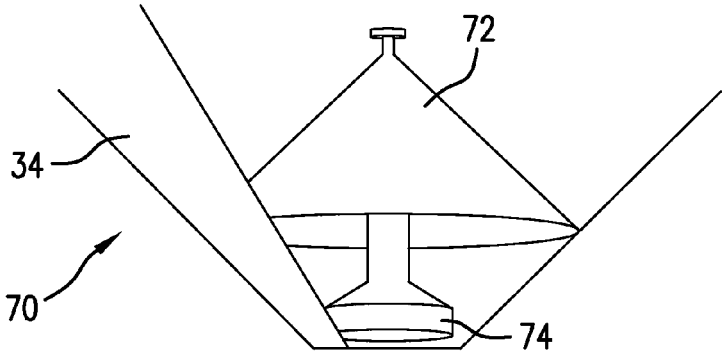
FIG. 4 shows a front view of an exemplary cone valve relative to a portion of the proppant silo.

As shown in FIG. 4, the exit portion 34 of the silo 24 may alternatively or additionally include a cone valve 70 that can be electrically or mechanically actuated to release the proppant from the silo 24 to the blender tub 44. A cone valve 70 include a cone-shaped closure assembly 72 having a closure operating member 74 in the form of a probe, which is raised or lowered by an actuator (not shown). Depending on the material used as proppant, a cone valve 70 can assist in preventing bridging or segregation within the silo 24.

Figure 5:
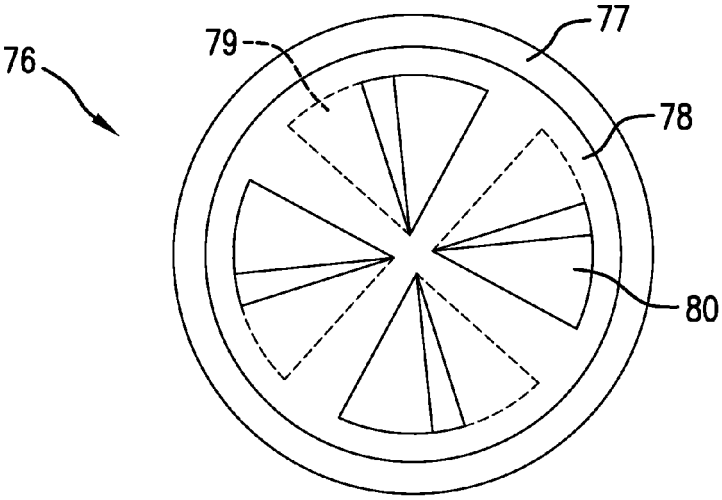
FIG. 5 shows a top view of an exemplary metering system for the proppant silo.

The silo 24 may incorporate a metering system to dole out a selected amount of proppant to the blender tub 44. FIG. 5 shows an exemplary metering system 76 in the form of a variable aperture device where an aperture is varied in size by moving a plurality of overlapping plates 77, 78. First plate 77 includes a first set of apertures 79, and second plate 78 includes a second set of apertures 80. When at least one of the first and second plates 77, 78 is moved relative to the other of the first and second plates 77, 78, the size of the available aperture is altered. Such a metering system 76 can be included at the output port 82 of the exit portion 34 at the downstream end 54 of the silo 24, or be included within the cone valve 70 or other valving structure of the silo 24. Any of the above-described gates, valves, and metering systems, as well as other selective blocking members 102, can be used separately or in combination within the silo 24 depending on customer requirements for a particular job or the type of proppant contained within the silo 24.

Other possible components for the silo 24 that are not shown include, but are not limited to, a vent pipe or venting structure at an upstream end 52 of the silo 24, ladder and ladder cage with handrails, catwalks, level indicators, view glass, and pressure release valve.

The transportable silo 24 of the proppant supply module 16 is tilted upward to rest in a tilted or an upright position within the support structure 36 as shown in FIG. 2. In an alternative exemplary embodiment, some of the support beams 38 may be disposed about the silo 24 prior to flipping up the silo 24 into the upright position, while some or a portion of the support beams 38, such as receiving rods, can be fixedly attached to the base 40 for alignment and receipt of the remainder of the support beams 38. In yet another exemplary embodiment, the base 40 includes apertures (not shown) for receiving support beams 38 that surround the silo and are alignable within the apertures of the base 40. Once the silo 24 is in the tilted or upright position, the support structure 36 maintains the silo 24 in a fixed position relative to the base 40. The support structure 36 may include a plurality of vertical support beams 84 and a plurality of cross beams 86 that interconnect adjacent vertical support beams 84. The cross beams 86 may be straight or have a curved shape.

As previously described, the base 40 includes piping, including first piping 48, for delivering components, other than components dispensed from the silo 24, to the blender tub 44. These other components include components necessary for blending with the proppant to form the slurry used as a fracturing fluid, and thus the first piping 48 is attached to gel line 22. The piping also includes second piping 50 for attachment with the slurry line 26, for delivering the slurry from the blender 18 to the high pressure pumps 28. In the exemplary embodiment of the fracturing fluid process plant 10, the piping 48, 50 includes rigid or at least substantially inflexible tubing or tubing pieces that are interconnected by tees and elbows as needed. The piping design allows for long-term purposes or a substantially permanent design that eliminates the need for dragging, lifting, and aligning flexible hoses during set-up of the fracturing fluid process plant 10. By fixedly positioning the piping 48, 50 relative to and onto the base 40 relative to the blender tub receiving area 46, set-up time is reduced. The piping 48, 50, may further include centrifugal pumps 30 as needed for directing the fluids to and from the blender tub 44. As will be further described below, the base 40 further includes additional piping extending from the blender 18 to the water supply module 12 as well as piping interconnecting the water supply module 12 and the chemical supply module 14. In one exemplary embodiment, the piping on the base 40 is arranged such that the water supply module 12 and the chemical supply module 14 may be interchangeably situated on the base 40 since the piping includes connection points at each module 12, 14, 16 allowing for fluid to be routed to and from any of the modules 12, 14, 16.

Figure 6:
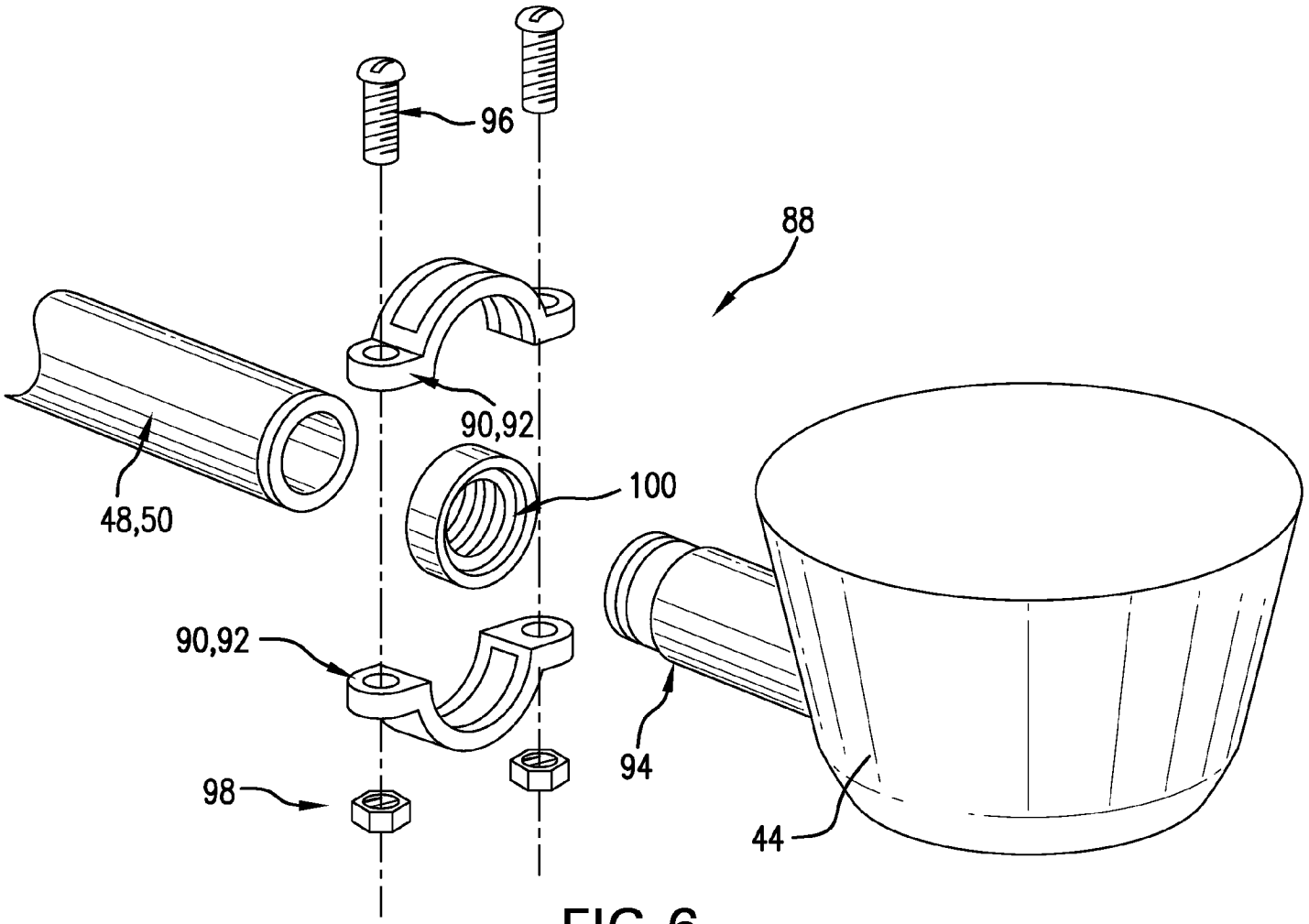
FIG. 6 shows a perspective of an exemplary clamp with respect to the blender tub.

With respect to the piping 48, 50, the piping 48, 50 can be integrally connected to the blender tub 44, or can be connected to the blender tub 44 using clamps, such as, but not limited to, clamp 88 shown in FIG. 6, to complete the process plant 10. The exemplary clamp 88 includes clamp portions 90, 92 that secure the piping 48 or 50 to a connection 94 on the blender tub 44. The clamp portions 90, 92 are securable together with fasteners such as screw 96 and nut 98, and may further secure a seal 100 or other gasket or connector there between. While an exemplary clamp 88 is shown, other quick connectors are also usable to secure the piping 48, 50 to a connection 94 on the blender tub 44. Because the piping 48, 50 is already positioned on the base 40, the assembly process of the processing plant 10 is quick, efficient, and does not require manipulating unwieldy hoses. Moreover, if the blender 18 is already positioned on the base 40 with the piping 48, 50 connected thereto, then the silo 24 only needs to be tipped in place onto the support structure 36 to complete the fracturing fluid process plant 10. The connection 94 or a connection in the piping 48, 50 further includes an actuatable valve to open and close the pathway between the piping 48, 50 and the blender tub 44 as needed.

The blender tub 44 is sized for receiving and blending the components of the fracturing fluid slurry. In one exemplary embodiment, because the silo 24 is designed to seat directly on top of the opening 42 of the blender tub 44, the blender tub 44 is closed off by the silo 24 so that components of the fracturing fluid cannot escape the blender tub 44 during blending. In an exemplary embodiment, the blender tub 44 is fitted onto the exit portion of the sand silo 24 prior to being set up onto the base 40. That is, the transportable silo 24 includes the blender tub 44 secured at its downstream end 54 during transport. When at the site, the blender tub 44 and silo 24 can be tilted onto the base 40 in unison, and then the pipes 48, 50 can be connected to the blender tub 44 using connections such as, but not limited to, the clamp shown in FIG. 6 to complete the rig up process. In another alternative exemplary embodiment, the blender tub 44 is situated on the base 40 of the support structure 36 awaiting the transportable silo 24. The opening 42 of the blender tub 44 includes a smaller opening mouth than a diameter of the storage tank portion 56 of the silo 24, but a diameter of at least one portion of the exit portion 34 of the silo 24 is smaller than the opening 42 in order to dispense the contents of the silo 24 into the blender tub 44 without spilling. The selective blocking member 102 can be utilized by an operator to limit the quantity of material dispensed from the silo 24 into the blender tub 44, and to adjust the rate of flow of the proppant supply 16 dispensed from the silo 24 into the blender tub 44.

Figure 7:
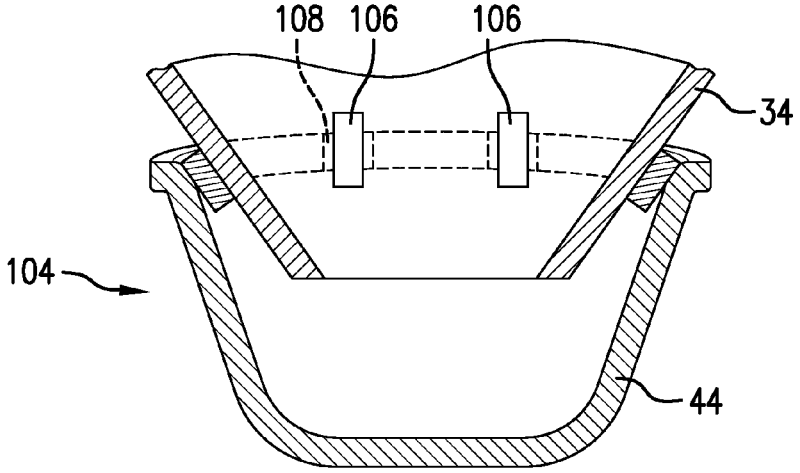
FIG. 7 shows a cross-sectional view of an exemplary embodiment of a blender tub and an exit portion of a silo.
Figure 8:
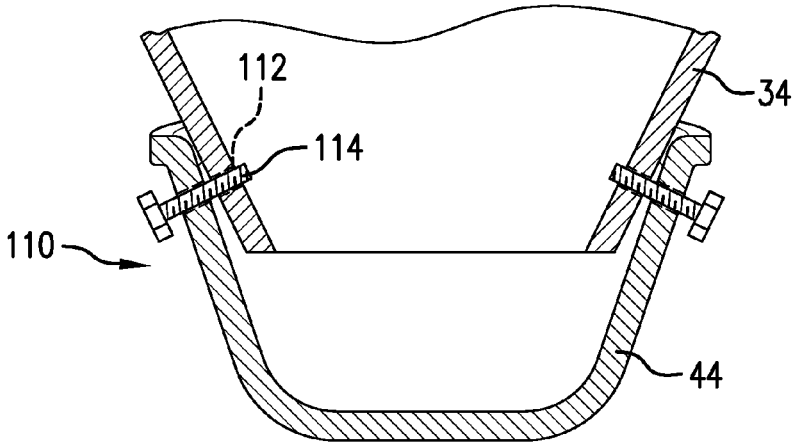
FIG. 8 shows a cross-sectional view of another exemplary embodiment of a blender tub and an exit portion of a silo.
Figure 9:
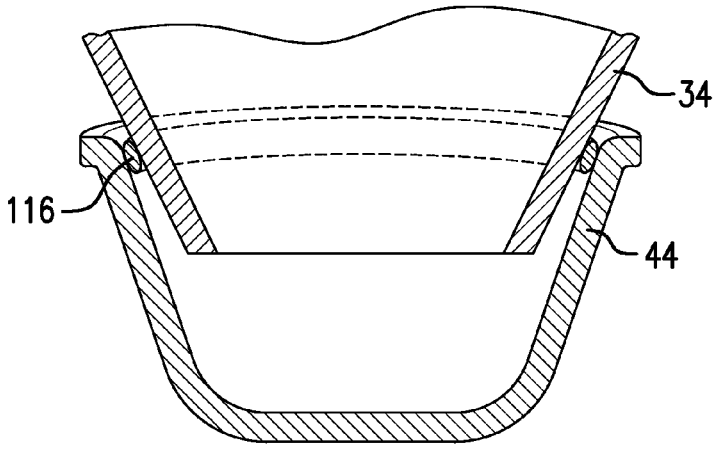
FIG. 9 shows a cross-sectional view of yet another exemplary embodiment of a blender tub and an exit portion of a silo.

While in one exemplary embodiment, the silo 24 is arranged above the opening 42 of the blender tub 44, such an embodiment would likely require a cover or closing member (not shown) for the opening 42 during blending. To eliminate the need for such a cover, in another exemplary embodiment, the blender tub 44 includes an engagement feature for engaging with an engagement feature of the silo 24 to provide a connection there between. The engagement feature of the silo 24 can be included on the tapered surface 58 of the exit portion 34 of the silo 24. With reference to FIG. 7, the engagement features can include at least one protrusion or indentation, snap-fit connection, etc. In an exemplary embodiment, the engagement features 104 include protrusions 106 on one of the exit portion 34 and blender tub 44 that align with slotted indentations 108 in the other of the exit portion 34 and blender tub 44. With reference to FIG. 8, engagement features 110 can include apertures 112 through one or both of the blender tub 44 and exit portion 34 for receiving a bolt, screw, or other fasteners 114. In addition to providing a fixed connection between the blender tub 44 and the silo 24, as shown in FIG. 9, a seal 116 can surround one or both of the blender tub opening 42 and the exit portion 34 to ensure a sealed connection there between, thus preventing any of the materials from exiting the blender tub 44 during blending through the use of a mixing apparatus 118, such as blender blades or the like within the blender tub 44.

While only one blender 18 is depicted in FIG. 1, in another exemplary embodiment, any of the modules 12, 14, 16 can include or be seated upon a blender tub, such as another blender tub 44, for mixing a subset of the materials used in a fracturing fluid. The blender tubs 44 can be connected via piping on the base 40 such that the fracturing fluid or portions thereof can be routed between blender tubs 44 as needed using actuated valves within the piping. In yet another exemplary embodiment, the silo 24 can be removed from the blender tub 44 and subsequently another silo 24 including a different material can be flipped above or onto the blender tub 44 to dispense another, different component of the fracturing fluid into the blender tub 44. In any of these embodiments, the units can be electric to allow for easy control of the materials from one blender tub 44 or silo 24 to another blender tub 44 or location through the use of control system 32.

Figure 10:
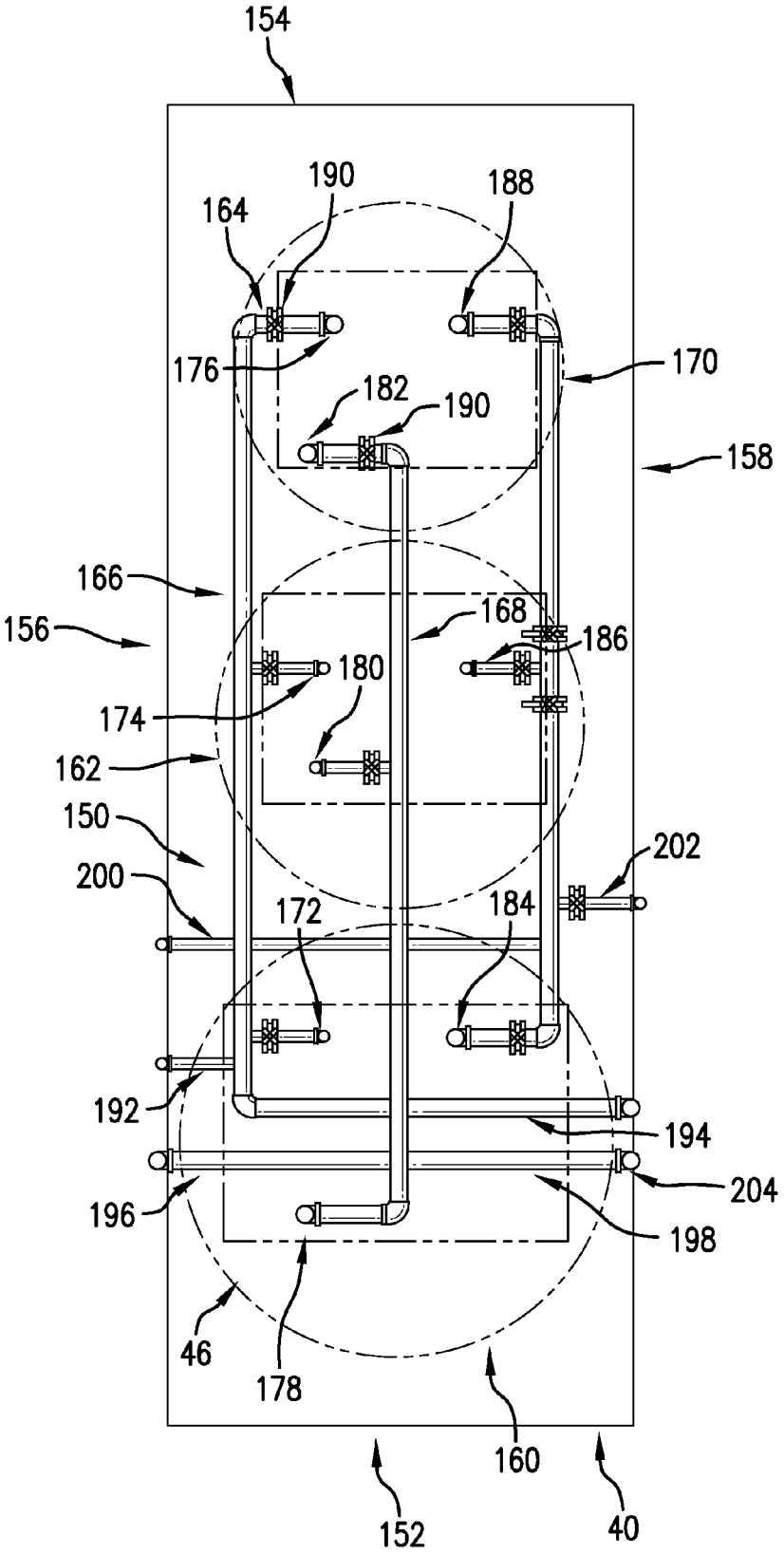
FIG. 10 shows a plan view of an exemplary embodiment of a base and integrated piping for the exemplary process plant.
Figure 11:
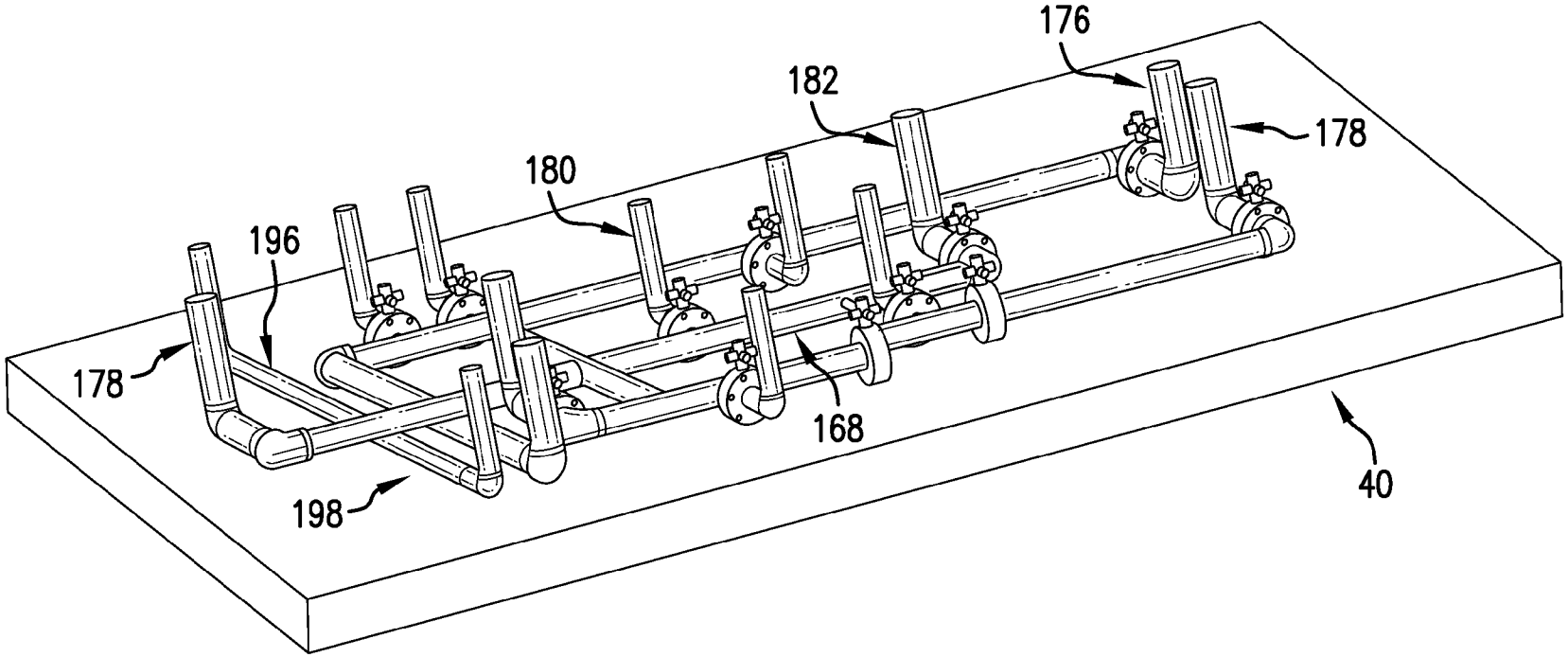
FIG. 11 shows a perspective view of another exemplary embodiment of a base and integrated piping for the exemplary process plant.
Figure 12:
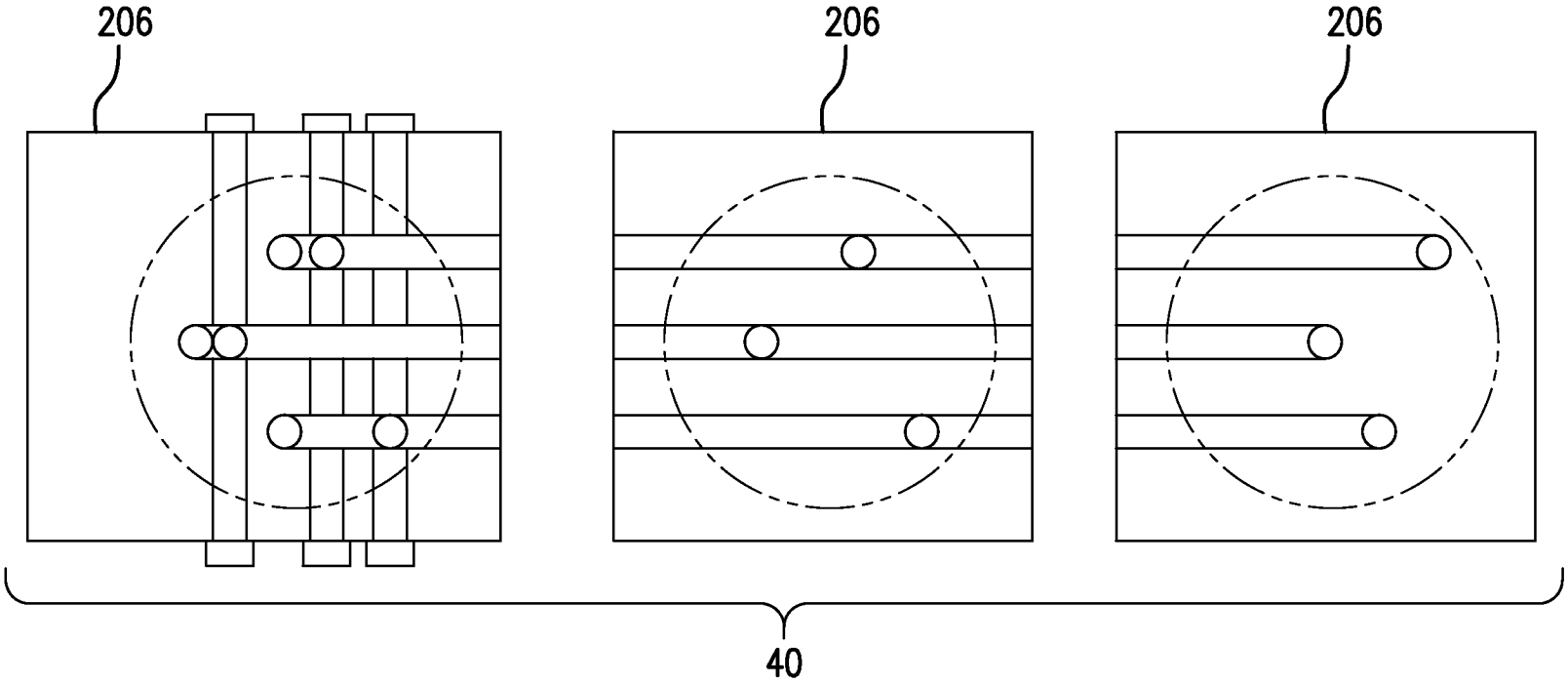
FIG. 12 shows a top plan view of yet another exemplary embodiment of a base and integrated piping for the exemplary process plant.

With reference now to FIGS. 10-12, exemplary embodiments of the base 40 including integrated piping 150 is shown. The base 40 includes a first end 152 and an opposite second end 154. The base 40 may be a trailer bed including wheels (not shown) that is towable by a truck. The base 40 may alternatively be a train flatbed car or other platform surface. When the base 40 is a movable surface, like a trailer bed or flatbed, the first end 152 or second end 154 is a leading end of the base 40 while the other of the first end 152 or second 154 is a trailing end. The base 40 further includes a first side 156 and an opposing second side 158 interconnecting the first and second ends 152, 154. The base 40 includes the blender tub receiving area 46, which thus incorporates an area for receiving the proppant supply module 16 on the base 40. While the blender tub receiving area 46 is shown adjacent the first end 152 of the base 40, the blender tub receiving area 46 may alternatively be positioned adjacent the second end 154 of the base 40 or in a central location of the base 40. The blender tub receiving area 46 of the base 40 is a first module receiving area 160. The base 40 further includes a second module receiving area 162 adjacent the first module receiving area 160, and a third module receiving area 164 between the second module receiving area 162 and the second end 154 of the base 40. For exemplary purposes only, the water supply module 12 may be located in the third module receiving area 164 of the base 40 and the chemical additive supply module 14 may be located in the second module receiving area 162 of the base 40. Together, the modules 12, 14, 16, blender 18 and base 40 with integrated piping 150 form a fracturing fluid process plant 10 capable of producing fracturing fluid. Regardless of the position of the modules 12, 14, 16 with respect to the base 40, the integrated piping 150, which extends between and provides connection points to all of the first, second, and third module receiving areas 160, 162, 164, allows the fluid to flow to and from the modules 12, 14, 16 as needed. The piping 150 includes first interconnection piping 166, second interconnection piping 168, and third interconnection piping 170. Each of the first, second, and third interconnection pipings 166, 168, 170 extend from the first module receiving area 160 to the third module receiving area 164. Each of the first, second, and third interconnecting pipings 166, 168, 170 includes first, second, and third connections that connect respectively to first, second, and third modules within the first, second, and third module receiving areas 160, 162, 164. That is, the first interconnection piping 166 includes first, second, and third connections 172, 174, 176, the second interconnection piping 168 includes first, second, and third connections 178, 180, 182, and the third interconnection piping 170 includes first, second, and third connections 184, 186, 188. The connections 172-188 are configured to be openable and closable as needed to create the desired paths between modules. Each of the connections 172-188 include the physical structure necessary to connect the respective pipings 166, 168, 170 to the supply module or blender contained within the respective module receiving area 160, 162, 164, such as, but not limited to, the clamp 88 shown in FIG. 6. Each, or at least some, of the connections 172-188 further includes at least one an actuatable valve, shown demonstratively as 190.

In the illustrated embodiment, the first interconnection piping 166 extends adjacent the first side 156 of the base 40, the third interconnection piping 170 extends adjacent the second side 158 of the base 40, and the second interconnection piping 168 extends between the first and third interconnection piping 166, 170. Each of the first, second, and third interconnection pipings 166, 168, 170 is connected to inlet and outlet piping to route fluid into the base 40 and direct fluid away from the base 40, respectively. More specifically, the first interconnection piping 166 is connected to first inlet piping 192 and first outlet piping 194, the second interconnection piping 168 is connected to second inlet piping 196 and second outlet piping 198, and the third interconnection piping 170 is connected to third inlet piping 200 and third outlet piping 202. Each of the inlet and outlet pipings 192-202 include connections shown collectively as 204 that are openable and closable as needed. The inlet and outlet pipings 192-202 can further include actuatable valves, similar to actuatable valve 190 located on convenient positions along the pipings 192-202 thereof, such as adjacent their respective interconnection pipings 166, 168, 170.

While FIG. 10 shows the inlet and outlet pipings 192-202 adjacent the first end 152 of the base 40, the inlet and outlet pipings 192-202 may alternatively be located at various locations along a length of the base 40. Also, while the inlet pipings 192, 196, 200 are depicted as extending in from the first side 156 of the base 40 and the outlet pipings 194, 198, and 202 are depicted as extending out from the second side 158 of the base 40, other arrangements may be incorporated. Further, while only one inlet and outlet piping 192-202 is shown for each interconnection piping 166, 168, 170, additional inlet and outlet pipings can be provided. Depending on specific job requirements, actuatable valves 190 are installed at the connections 172-188 and elsewhere along the interconnection pipings 166, 168, 170 and inlet and outlet pipings 192-202 as needed to provide for routing of the fluids between the modules 12, 14, 16, blender 18 and to and from the base 40.

Thus, the integrated piping 150 allows for a wide variety of operational functions. In addition to the method of producing fracturing fluid as described above with respect to FIG. 1 with the modules 12, 14, 16 providing materials to the blender 18, the inlet piping 192, 196, 200 may also provide materials to the blender 18 or to the modules 12, 14, 16 themselves. Materials from any of the modules 12, 14, 16 or a combination thereof may be redirected from the base 40 via the outlet piping 194, 198, 202 to another base as needed or to the pumps 28 shown in FIG. 1. Also, any of the modules 12, 14, 16 could be replaced with another of the modules 12, 14, 16 during operation, and any of the modules 12, 14, 16 could be equipped with a blender 18 as needed. While three module receiving areas 160, 162, 164 are depicted, the base 40 may include additional module receiving areas and be equipped with additional interconnection piping and inlet and outlet piping as needed. Also, as shown in FIG. 12, the base 40 may be divided into base units 206 each including a sub section of the interconnection piping 166, 168, 170 and each including at least one module receiving area 160, 162, 164 such that when the base units 206 are placed adjacent to one another to form the base 40, the sections of the interconnection piping 166, 168, 170 are connected to form the integrated piping 150 as shown in FIG. 10. Thus, the process plant 10 provides great flexibility in accommodating different requirements and sizes for frac jobs as well as other processing jobs.

Thus, an integrated silo 24, blender tub 44, and support structure 36 with piping system 48, 50 has been described that allows for a creation of an integrated fracturing fluid process plant 10 which requires minimal operators on the equipment, as well as reducing overall structure that is required to process fracturing fluid, thus potentially decreasing maintenance costs and reducing time for set-up. A process plant 10 has been further described that provides flexibility to meet the demands of varying operational requirements.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A process plant comprising:

a substantially planar base having a plurality of module receiving areas including at least first, second, and third module receiving areas, the second module receiving area disposed between the first and third module receiving areas, the plurality of module receiving areas configured to receive a plurality of supply modules, respectively, and a blender received in at least one of the receiving areas;

a plurality of interconnection pipings including at least first, second, and third separate interconnection pipings fixedly integrated with the base, the first interconnection piping interconnecting the first, second, and third module receiving areas to each other, the second interconnection piping interconnecting the first, second, and third module receiving areas to each other, and the third interconnection piping interconnecting the first, second, and third module receiving areas to each other;

connections on each of the first, second, and third interconnection pipings at each of the first, second, and third module receiving areas, each connection configured to selectively connect and disconnect either a supply module amongst the plurality of supply modules or the blender within a respective module receiving area from its respective interconnection piping;

the blender including a blender tub, the blender tub sized to receive and blend components from the plurality of supply modules disposed respectively in the module receiving areas, the blender tub disposed in and on one of the module receiving areas; and, a proppant supply module amongst the plurality of supply modules, separate from the blender tub, disposed in a same module receiving area as the blender tub, the proppant supply module having a silo, the silo arranged above the blender tub and having an exit portion longitudinally aligned with an opening of the blender tub, the exit portion arranged to directly dispense from the silo into the opening; and, a first centrifugal pump arranged on the base within the same module receiving area as the blender tub and proppant supply module, the first centrifugal pump configured to pump fracturing fluid from the blender away from the base.

2. The process plant of claim 1 further comprising outlet piping connected to at least one of the plurality of interconnection pipings, the outlet piping arranged to direct fluid from the blender away from the base, the outlet piping including a connection configured to selectively prevent and allow egress of fluid from its respective interconnection piping.

3. The process plant of claim 2 further comprising a pressurizing pump, the outlet piping delivering fracturing fluid from the first centrifugal pump to the pressurizing pump.

4. The process plant of claim 2 wherein the outlet piping is arranged to direct fluid from one of the plurality of interconnection pipings to another base.

5. The process plant of claim 1 further comprising inlet piping connected to at least one of the plurality of interconnection pipings, the inlet piping arranged to direct fluid to the base, the inlet piping including a connection configured to selectively prevent and allow entry of fluid into its respective interconnection piping.

6. The process plant of claim 1 wherein each connection includes an actuatable valve to selectively connect and disconnect either one of the plurality of supply modules or the blender within a respective module receiving area from its respective interconnection piping.

7. The process plant of claim 1, further comprising a water supply module and a chemical additive supply module amongst the plurality of supply modules, the water supply module in the first module receiving area and the chemical additive supply module in the second module receiving area, the first interconnection piping delivering water from the water supply module to the chemical additive supply module to create a gel.

8. The process plant of claim 7, wherein the blender tub is disposed in the third module receiving area and arranged to receive proppant from the silo also in the third module receiving area, the second interconnection piping delivering the gel to the blender tub to mix with the proppant.

9. The process plant of claim 1, wherein the interconnection pipings are substantially inflexible.

10. The process plant of claim 1, wherein the exit portion of the silo is configured to engage with the opening of the blender tub and is fixedly secured thereon.

11. The process plant of claim 1, further comprising a support structure extending from the base, the support structure including support beams at least partially surrounding at least one of the module receiving areas.

12. The process plant of claim 1 wherein the base is a flatbed for a trailer or train.

13. The process plant of claim 1 further comprising a second centrifugal pump on at least one of the plurality of interconnection pipings.

14. The process plant of claim 1 further comprising the base including a plurality of interconnected and separable substantially planar base units, wherein each base unit includes a portion of the plurality of interconnection pipings, and the portion of the plurality of interconnection pipings of each base unit is arranged to connect to the portion of the plurality of interconnection pipings of an adjacent base unit.

15. The process plant of claim 1 further comprising an electrical control system configured to electrically control opening and closing the connections.

16. A method of processing a fracturing fluid using the process plant of claim 1, the method comprising:

providing a water supply module amongst the plurality of supply modules in the first module receiving area;

providing a chemical additive supply module amongst the plurality of supply modules in the second module receiving area;

and providing the proppant supply module and the blender within the third module receiving area of the base;

creating a gel by selectively opening and closing the connections on the first, second, and third interconnection pipings to create a pathway from the water supply module to the chemical additive supply module;

selectively opening and closing the connections on the first, second, and third interconnection pipings to create a pathway to deliver the gel from the chemical additive supply module to the blender; and adding proppant from the proppant supply module to the blender tub and blending the proppant with the gel to form the fracturing fluid.

17. The method of claim 16, further comprising fixedly securing outlet piping to at least one of the interconnection pipings and directing fracturing fluid away from the blender using the outlet piping and the first centrifugal pump.

* * * * *